United States Patent [19]

Souillard et al.

[11] 3,953,179

[45] Apr. 27, 1976

[54] LUBRICATING COMPOSITIONS

[75] Inventors: Georges Jules Souillard; Frederic Francois Van Quaethoven, both of Wezembeek, Oppem, Belgium

[73] Assignee: Labofina S.A., Brussels, Belgium

[22] Filed: Feb. 8, 1973

[21] Appl. No.: 330,757

[30] Foreign Application Priority Data

Apr. 4, 1972 Belgium ..... 115915

[52] U.S. Cl. ..... 44/58; 252/56 R

[51] Int. Cl.[2] ..... C10L 1/10

[58] Field of Search ..... 44/58; 252/56 R

[56] References Cited

UNITED STATES PATENTS

| | | | |
|---|---|---|---|
| 2,951,094 | 8/1960 | Hefner et al. | 44/58 X |
| 3,004,837 | 10/1961 | Riemenschneider | 44/58 |
| 3,235,494 | 2/1966 | Piatt et al. | 44/58 X |
| 3,518,197 | 6/1970 | Eckert | 252/56 R |
| 3,621,004 | 11/1971 | Eckert | 252/56 R X |
| 3,639,242 | 2/1972 | LeSuer | 252/56 R |
| 3,694,176 | 9/1972 | Miller | 252/56 R X |

*Primary Examiner*—Paul F. Shaver

[57] ABSTRACT

A lubricating composition for 2-stroke, internal combustion engines comprising 90 to 97% by weight of a lubricant mixture comprising 15 to 80% by weight of a polymer selected from the group consisting of hydrogenated and non-hydrogenated polybutene, polyisobutylene and mixtures thereof, with a mean molecular weight ranging from 250 to 2000, and 0.5 to 10% by weight of a triglyceride of an unsaturated aliphatic carboxylic acid containing 18 carbon atoms, and the remainder being a lubricating oil, and 3 to 10% by weight of conventional lubricating oil additives for 2-stroke engines.

5 Claims, No Drawings

LUBRICATING COMPOSITIONS

BACKGROUND OF THE INVENTION

This invention relates to lubricating compositions used in admixture with fuels. More particularly, the present invention relates to lubricating compositions used in admixture with fuels which lubricants are employed to lubricate moving parts of 2-stroke engines.

In recent years, the evolution and technical progress in all types of internal combustion engines, and particularly in the field of 2-stroke engines, have led to engines of higher and higher horsepower. For example, outboard engines with a horsepower higher than 50 hp and even up to 100 hp and higher are commonly manufactured today. Another aspect of this evolution is the development of small air-cooled engines, not only for such vehicles as motorcycles, but also for chain saws, skidoos or snowmobiles, and the like. A feature of these engines is their high speed of rotation which results in their running hotter than their lower speed predecessors. Such evolution and technical progress has led to an increase in the severity of lubrication requirements for 2-stroke engines.

The lubricant useful in these new engines must form a stable and oily film, which at low temperatures will make easier the starting of the engine even under cold weather conditions. Additionally, such lubricant must perform well at the higher operating temperatures of the newer engines in order to avoid piston fouling, ring groove plugging and lacquering, formation of deposits, etc. which lead to a drastic reduction of power output and often results in expensive damage. Further, the exhaust gases resulting from the combustion of the fuel together with a part of the lubricant must be clean and have a minimum of the odors which are characteristic of most all 2-stroke engines. Other requirements, more particularly in the economic field, such as reduction of the oil to fuel ratio and a decrease in the amount of conventional additives, are coupled with the above criteria.

Several lubricating compositions for 2-stroke engines have been suggested to fulfill one or the other of the above criteria conditions. A feature of some of these compositions is the use of olefin polymers, more particularly polyisobutylene (which is readily available and inexpensive), as an additive for mineral or synthetic oil or base oil. In such compositions, polyisobutylene generally is added to the base oil in an amount which does not exceed 20% by volume. Usually, the polymers used in these known compositions are those having a mean molecular weight of between 10,000 and 15,000. It also has been suggested to add to the base oil, polyisobutylene in the form of an additive mixture comprising a major part of calcium petroleum sulfonate and a minor part of polyisobutylene, this additive mixture being used in an amount corresponding to about 1 to 5 volume % based on the total composition. These compositions have resulted in technical improvement when compared with prior and more conventional lubricants. However, these polymer containing compositions still have some disadvantages, particularly with respect to the thermal properties and cleanliness of the exhaust gases.

In order to overcome these disadvantages, lubricating compositions comprising a major part of polyisobutylene have been investigated. In such compositions, this polymer is mixed with a lubricating oil in an amount at least equal to the amount of this oil. Such compositions have shown favorable results and additional investigation has been carried out to further improve the qualities and performance of the lubricating compositions, particularly with respect to their behavior under high mechanical and thermal stresses for extended periods of time.

It is an object of the present invention to provide new and improved lubricating compositions.

Another object of the present invention is to provide new and improved lubricating compositions for admixture with fuels for 2-stroke engines.

A further object of the present invention is to provide new and improved lubricating compositions for admixture with fuels for 2-stroke engines which lubricating compositions have improved properties with respect to use under high mechanical and thermal stresses.

Additional objects will become apparent from the following description of the invention herein disclosed.

SUMMARY OF THE INVENTION

The present invention, which fulfills these and other objects, is a lubricating composition for 2-stroke engines which comprises 90 to 97% by weight of a lubricating mixture comprising 15 to 80% by weight of a polymer selected from the group consisting of hydrogenated and non-hydrogenated polybutene, polyisobutylene and mixtures thereof, having a mean molecular weight ranging from 250 to 2000, and 0.5 to 10% by weight of a triglyceride of an unsaturated aliphatic acid containing 18 carbon atoms, the remainder of said mixture being a lubricating oil, and 3 to 10% by weight of lubricating oil additives for 2-stroke engines.

The polybutene, or polyisobutylene, which may be saturated or unsaturated, and their mixtures, will be hereinafter referred to as "Poly-$C_4$".

DESCRIPTION OF THE PREFERRED EMBODIMENTS

The Poly-$C_4$'s of the present invention are manufactured from fractions containing hydrocarbons with 4 carbon atoms, the primary constituents being monoolefins, in admixture with saturated hydrocarbons. These fractions which are free of diolefinic and acetylenic hydrocarbons, are polymerized, most often in the presence of a Friedel-Craft catalyst such as aluminum chloride. In many instances, the resulting polymers contain polybutene and polyisobutylene in varying proportions. Generally, these polymers contain about 5 to 70% of polyisobutylene and 95 to 30% of polybutenes. These polymers have nonsaturated terminal groups.

By comparative tests carried out with lubricating compositions according to the present invention, containing polymers consisting primarily of polybutene and polymers consisting primarily of polyisobutylene, it has been found that lubricating compositions prepared with such polymers are very similar with regard to their performance. Further, is has been found that hydrogenated and non-hydrogenated polymers give substantially equivalent performance particularly with respect to viscostability.

Thermal stability tests carries out with Poly-$C_{-4}$'s have shown that the polymers with a mean molecular weight of between 250 and 2000 are more stable than Poly-$C_4$'s having higher molecular weights. As indicated above, behavior of lubricants at high temperatures is a very important factor in 2-stroke engines.

Therefore, the lubricating compositions of the present invention generally contain Poly-$C_4$ having a mean molecular weight lower than 1000 and preferably contain Poly-$C_4$ having a mean molecular weight between 250 and 750.

The amount of Poly-$C_4$ employed in the lubricating compositions of the present invention may be varied between from about 15% to 80% by weight of the lubricating mixture (without conventional additives) which forms the major part of the composition. Wear tests carried out with compositions containing varying amounts of Poly-$C_4$ have shown that compositions with at least 15% of Poly-$C_4$ in the lubricating mixture have better anti-wear characteristics than similar compositions free of Poly-$C_4$. The improvement in wear resistance increases when the amount of polymer is increased and is most substantial when such amount is between 25 and 75% by weight. Moreover, a noticeable reduction in opacity and "burned oil" odor of the exhaust gases results from the use of lubricating compositions containing at least 25% of Poly-$C_4$ and, preferably, containing Poly-$C_4$ in an amount of at least 30%. Generally, the Poly-$C_4$'s of lower molecular weight are used in amounts up to 80% by weight. Poly-$C_4$'s of higher molecular weight ranging from about 1000 to 2000 preferably are employed in lower amounts, preferably between 15% and 40%.

Motor tests have been carried out with lubricating compositions containing Poly-$C_4$ and triglycerides of unsaturated fatty acids, with conventional additives for 2-stroke engines. These tests have shown that these compositions do not lead to substantial deposits, but that the ball bearings tend to stick. It has been found that this disadvantage may be obviated by adding a lubricating oil to such compositions. With the addition of such oil, an oily and stable lubricating film is formed on the moving parts of the engines, particularly on the ball bearing surfaces, resulting in improved and long lasting protection of the motor.

The amount of lubricating oil added is at least 10% of the weight of the lubricating mixture which forms the major part of the composition. This oil may be a mineral or organic, synthetic oil, of the ester type, for example, an adipic, axelaic, sebacic acid ester of aliphatic alcohol with 8 to 20 carbon atoms, such as 2-ethylhexanol, decanol, dodecanol, octadecanol. Mixtures of mineral and synthetic oils may also be used, though such mixtures generally have not led to sufficient improvement in performance to justify the additional cost resulting from the use of synthetic oils.

Compositions containing Poly-$C_4$ and lubricating oil offer improvements by comparison with prior conventional lubricants. However, in order to increase oil film stability, particularly with the hotter running new 2-stroke engines, it is advantageous to incorporate into the compositions triglycerides of unsaturated aliphatic carboxylic acids containing 18 carbon atoms, preferably glyceryl trioleate and glyceryl trilinoleate. The improvement from such addition becomes apparent when the amount of triglyceride is 0.5% by weight or above. Amounts of triglyceride as high as 10% by weight may be used, but more often the amount of tryglyceride will be varying between 0.5 and 8% of the weight of the lubricating mixture of the compositions. A composition prepared in accordance with the present invention and containing 1% by weight of triglyceride was tested in a high-speed engine for 100 hours. After this test, it was observed that the pistons were coated by an oily film and had a "fatty" appearance. By contrast, a similar composition without triglyceride tested under similar conditions resulted in the pistons being dry.

The improved thermal and mechanical stability of the oil film appears to be the result of a synergistic effect which is obtained when Poly-$C_4$ is used in combination with a triglyceride as defined hereinabove. It appears that the triglyceride improves the wetting power and the spreadability of the Poly-$C_4$. Such synergistic effect is obtained when the Poly-$C_4$ is used in an amount of between 15 and 80% of the lubricating mixture of the composition and the triglyceride is added in a quantity which varies between 0.5 and 10% by weight. Preferably, the ratio by weight of said triglyceride to said polymer is within the range 1 : 10 to 1 : 30 and, preferably within the range 1 : 20 to 1 : 30.

The concomitant use of the three components of the lubricating compositions in accordance with the present invention is necessary for the compositions to fulfill the severe requirements of the newer high-speed small engines or of the newer high horse-power outboard engines. The mechanical and thermal stability of the compositions are drastically reduced when one of the three components is not used or is substituted by a similar component having properties which do not satisfy the above given specifications. For example, the use of a Poly-$C_4$ having a molecular weight higher than 2000 leads to the formation of varnishes on some moving parts of the engine.

The compositions according to the present invention contain 3 to 10% by weight of conventional additives for 2-stroke engines. Such additives are, for example, detergent agents such as alkaline-earth petroleum sulfonates, or ashless additives, or lead-scavenging agents such as halogenated alkyl and alkylaryl hydrocarbons, and their mixtures.

The compositions of the present invention are soluble in the usual fuels for 2-stroke engines and the solutions are storage stable. In many cases, it is desirable to previously dilute such compositions with kerosene-type hydrocarbons in order to facilitate handling and mixing, particularly at lower temperatures. For example, solutions containing 20% by weight of solvent and 80% by weight of the compositions of the present invention are easily handled even at temperatures as low as −40°C.

The following examples further illustrate the present invention. Such examples are not, however, to be construed as limiting the present invention. In these examples, all percentages are by weight.

EXAMPLE 1

A lubricating composition was prepared as follows:

96% lubricating mixture containing
- 30% of Poly-$C_4$ 300 (300 = mean molecular weight)
- 1% glyceryl trioleate
- 69% mineral oil (75SSU at 100°F) (solvent refined coastal)

4% of an additive mixture for 2-stroke engines containing 1% of lead-scavenging agent and 3% of calcium petroleum sulfonate.

This lubricating composition had a viscosity of 14 centistrokes at 210°F.

Road tests were carried on a YAMAHA TR 28 motorcycle (cylinder capacity : 350 $cm^3$ ; power : 54 hp DIN at 9,500 r.p.m.), employing the composition in admixture with the normal fuel. The test was performed over a distance of 150 km, at high speed, the engine running under severe operating conditions. After the road test, the motor was examined and the wear of the chrome-plated aluminum cylinders evaluated. The examinations were carried out at four different levels of each cylinder and, for each level, two numbers are given: the first one for wear in one direction and the other for wear in a perpendicular direction. The wear is given in 1/1000 mm.

| | | | |
|---|---|---|---|
| Left cylinder | 15–10 | Right cylinder | 15–12 |
| | 15–15 | | 15–10 |
| | 25–15 | | 15–15 |
| | 10–15 | | 10–5 |

or a mean wear of 13 (in 1/1000 mm).

EXAMPLES 2 through 7

Compositions as described in Example 1 were prepared from lubricating mixtures containing varying amounts of Poly-$C_4$, glyceryl trioleate and mineral oil. The amounts are given in the following table, along with the mean wear of the cylinders.

| Example No | Lubricating Mixture | | | Mean wear (in 1/1000 mm) |
|---|---|---|---|---|
| | Poly-$C_4$-400 | Glyceryl trioleate | Mineral Oil | |
| 2 | 30 | 0.5 | 69.5 | 23 |
| 3 | 30 | 1 | 69 | 12 |
| 4 | 30 | 5 | 65 | 10 |
| 5 | 30 | 7.5 | 62.5 | 9 |
| 6 | 50 | 2 | 48 | 12 |
| 7 | 70 | 3 | 27 | 12 |

These examples 2 through 7 illustrate the improvement from using glyceryl trioleate, particularly in an amount corresponding to at least 1% by weight of the lubricating mixture. It is to be noted that the improvement increases when the amount of this component increases up to about 8% by weight.

EXAMPLE 8

The composition of Example 1 was duplicated except that the lubricating mixture contained 20% of Poly-$C_4$ 300 and 10% of octodecyl adipate.

The wear of the cylinders was:

| | | | |
|---|---|---|---|
| Left cylinder: | 38–38 | Right cylinder: | 40–30 |
| | 8–8 | | 15–15 |
| | 15–1 | | 18–10 |
| | 1–0 | | 0–5 |

or a mean wear of 15 (in 1/1000 mm).

EXAMPLE 9

The composition of Example 1 was again duplicated with a non-hydrogenated polyisobutylene having a mean molecular weight of 320.

The mean wear of the cylinders was 18 (in 1/1000 mm).

EXAMPLE 10

A lubricating composition was prepared as follows:

94% of a lubricating mixture containing
- 30% of hydrogenated Poly-$C_4$ of 600 average molecular weight
- 1% of glyceryl trioleate
- 69% of solvent refined coastal oil (75 SSU at 100°F)

6% of an additive mixture containing 3% of calcium petroleum sulfonate, 1% of lead-scavenging agent and 2% of ashless additive.

Road tests were carried out with a YAMAHA TR 2B motorcycle over 170 km, under cold weather conditions, the ambient temperature being about 5°C. The results of this test were as follows:

mean wear of the cylinders : 5 (in 1/1000 mm)
pistons : perfectly clean, no wear
lower part of the motor : perfectly lubricated and no unusual slack.

By way of comparison, four similar tests were carried out with lubricating compositions containing the same amounts of the above additives with 94% of different lubricating mixtures. These lubricating mixtures and the results obtained in such testing are described below:

Comparative mixture A

99% of solvent refined coastal oil
1% of glyceryl trioleate

After 72 km, the engine was seized up.

Comparative mixture B

93% of the oil of mixture A.
1% of glyceryl trileate
6% of Poly-$C_4$ of 520 average molecular weight.

Brown varnishes formed on the pistons. Mean wear of the cylinders after 92 km was 100 (in 1/1000 mm).

Comparative mixture C

83% of the oil of mixture A.
17% of Poly-$C_4$ of 520 average molecular weight.

The pistons were dry. Mean wear of the cylinders after 120 km was 95 (in 1/1000 mm).

Comparative mixture D

69% of the oil of mixture A.
1% of glyceryl trioleate
30% of Poly-$C_4$ of 2600 average molecular weight.

Brown varnishes formed on the pistons. Mean wear of the cylinders was 150 (in 1/1000 mm). Significant deposits were found (test during 120 km).

These results which were obtained under particularly severe road tests and not simply by static tests further illustrate the benefits derived from the use of the compositions of the present invention, particularly with regard to the efficiency of the lubricants under severe mechanical and thermal stresses.

EXAMPLE 11

A lubricating composition was prepared as follows:

98% of a lubricating mixture containing
- 40% of Poly-$C_4$ of 320 average molecular weight
- 1% of glyceryl trilinoleate
- 59% of solvent refined coastal oil 2% of an additive mixture containing 1% of calcium petroleum sulfonate and 1% of lead-scavenging agent.

This composition was used in admixture with leaded gasoline, the volumetric ratio of lubricant to gasoline being 5 : 100. A Mercury outboard motor (6 cylinders : 95 HP) was operated for this run, in water at a temperature which was kept lower than 20°C. After this run (100 hours in duration), it was observed that the pistons were coated by a slightly yellow varnish on an area corresponding to about 20% of the area of the piston skirt, the remaining area being clean. Further, with respect to ring sticking, the mean merit rate was 9 (a free ring is accorded 10 points, a sluggish ring 9 points and stuck rings are evaluated at 7 points for up to 45° sticking, etc.)

By contrast with the above results, using a lubricant which was suitable for a 35–40 horsepower outboard under the same conditions, it was observed that about 75% of the piston area was coated with a dark brown varnish and the merit rate was only 7. This comparative test illustrates that technical development in the field of 2-stroke engines has led to an increase in the severity of lubrication requirements.

EXAMPLE 12

Tests were carried out to illustrate the oil film stability of the compositions of the present invention. The lubricant composition of Example 1 and lubricant composition employing mixtures A through D of Example 10 were tested. A 49 $cm^3$ motorcycle was operated with a mixture of gasoline and lubricant, the mixture containing 6% lubricant. The engine was started up on this mixture and after 1 hour, the mixture was replaced by straight gasoline, and the time taken for the engine to lose 50% of its power due to piston seizure was noted.

The results of tests were as follows:

Composition from Example 1: The test has been stopped after 2 hours, the engine having only lost 25% of its power.

Comparative composition A: 50% power loss after 180 minutes.

Comparative composition B: 50% power loss after 100 minutes.

Comparative composition C: 50% power loss after 120 minutes.

Comparative composition D: 50% power loss after 110 minutes.

However, 2-stroke engines operating with compositions of the present invention give cleaner exhaust gases with less odor. Comparative tests were made with gasoline containing 4% of lubricating compositions. The exhaust gases were collected in a known Hartridge smokemeter, which works on the principle of partially obscuring a light beam by smoke circulating through a pipe. The Hartridge scale is calibrated from 0–100, the lower figure indicating the less opaque gases. Again the lubricating composition of Example 1 and the mixtures A through D of Example 10 were tested. In addition, the lubricating composition of Example 2 was tested. The tests were conducted on a 250 $cm^3$ engine.

The results were as follows:

Composition of Example 1 : Hartridge reading = 29
Composition of Example 2 : Hartridge reading = 30
Comparative composition A : Hartridge reading = 99
Comparative composition B : Hartridge reading = 47
Comparative composition C : Hartridge reading = 37
Comparative composition D : Hartridge reading = 36

What is claimed is:

1. A lubricating composition for 2-stroke internal combustion engines, comprising 90 to 97% by weight of a lubricant mixture comprising 15 to 80% by weight of a polymer selected from the group consisting of hydrogenated and non-hydrogenated polybutene, polyisobutylene and mixtures thereof, with a mean molecular weight ranging from 250 to 2000, and 0.5 to 10% by weight of a triglyceride of an unsaturated aliphatic carboxylic acid containing 18 carbon atoms, and the remainder being a lubricating oil selected from the group consisting of mineral oil and esters of a polybasic carboxylic acid and an aliphatic alcohol having from 8 to 20 carbon and mixtures thereof, and 3 to 10% by weight of conventional lubricating oil additives for 2-stroke engines.

2. The lubricating composition of claim 1 wherein the polymer has a molecular weight of between 250 and 1000.

3. The lubricating composition of claim 1 wherein the amount of polymer in said lubricant mixture is between 25 and 75% by weight.

4. The lubricating composition of claim 1 wherein the ratio by weight of said triglyceride to said polymer is 1 : 10 to 1 : 30.

5. The lubricating composition of claim 1 wherein the triglyceride is selected from the group consisting of glyceryl trioleate and glyceryl trilinoleate.

* * * * *